US010003125B2

(12) United States Patent
Yoon et al.

(10) Patent No.: US 10,003,125 B2
(45) Date of Patent: Jun. 19, 2018

(54) ELECTRONIC DEVICE INCLUDING ANTENNA

(71) Applicant: Samsung Electronics Co., Ltd, Gyeonggi-do (KR)

(72) Inventors: Byung-Tae Yoon, Gyeonggi-do (KR); Jong-Wook Zeong, Gyeonggi-do (KR); Hak-Sul Kim, Gyeonggi-do (KR); Seung-Hyeok Na, Seoul (KR); Byung-Woog Bae, Gyeonggi-do (KR); Mi-Hyun Son, Seoul (KR); Tae-Young Lee, Seoul (KR); Chang-Rae Jeong, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 794 days.

(21) Appl. No.: 14/081,997

(22) Filed: Nov. 15, 2013

(65) Prior Publication Data

US 2014/0139393 A1 May 22, 2014

(30) Foreign Application Priority Data

Nov. 16, 2012 (KR) ..... 10-2012-0130248

(51) Int. Cl.

| | |
|---|---|
| ***H01Q 1/24*** | (2006.01) |
| ***H01Q 1/48*** | (2006.01) |
| ***H01Q 9/42*** | (2006.01) |
| ***H01Q 21/08*** | (2006.01) |

(52) U.S. Cl.

CPC ..... *H01Q 1/246* (2013.01); *H01Q 1/48* (2013.01); *H01Q 9/42* (2013.01); *H01Q 21/08* (2013.01)

(58) Field of Classification Search

CPC ..... H01Q 1/246; H01Q 21/00; H01Q 21/08; H01Q 1/48; H01Q 9/42; H01Q 1/50

USPC ..... 343/845, 872

See application file for complete search history.

(56) References Cited

U.S. PATENT DOCUMENTS

| | | | | |
|---|---|---|---|---|
| 5,940,044 | A * | 8/1999 | Smith | H01Q 1/246 343/794 |
| 6,034,649 | A * | 3/2000 | Wilson | H01Q 1/246 343/795 |
| 7,339,534 | B2 * | 3/2008 | Jeong | H01Q 1/243 343/702 |
| 7,629,939 | B2 * | 12/2009 | Deng | H01Q 1/246 343/799 |
| 2007/0001919 | A1 * | 1/2007 | Carroll | H01Q 1/246 343/757 |
| 2008/0252552 | A1 * | 10/2008 | Goebel | H01Q 1/246 343/872 |

(Continued)

FOREIGN PATENT DOCUMENTS

CN 201584490 U * 9/2010

*Primary Examiner* — Dameon E Levi
*Assistant Examiner* — Jennifer F Hu

(57) ABSTRACT

An electronic device includes a main board, a ground plate, at least one antenna, and at least one cable. The ground plate is disposed on the main board and include at least one cable containing groove containing at least a part of the at least one cable. The at least one antenna is disposed on the ground plate and electrically connected to the ground plate. The at least one cable electrically connects the at least one antenna with the main board and is at least partially disposed in the at least one cable containing groove.

20 Claims, 12 Drawing Sheets

(56) References Cited

U.S. PATENT DOCUMENTS

| | | | | |
|---|---|---|---|---|
| 2008/0266198 | A1* | 10/2008 | Walker | G06F 1/1616 343/846 |
| 2010/0283710 | A1 | 11/2010 | Lutman et al. | |
| 2011/0216492 | A1* | 9/2011 | Murakata | G06F 1/16 361/679.08 |

* cited by examiner

ELECTRONIC DEVICE INCLUDING ANTENNA

PRIORITY

The present application is related to and claims priority under 35 U.S.C. § 119 to an application filed in the Korean Intellectual Property Office on Nov. 16, 2012 and assigned Serial No. 10-2012-0130248, the contents of which are incorporated herein by reference.

TECHNICAL FIELD

Various embodiments of the present disclosure relates generally to an electronic device capable of including an antenna function.

BACKGROUND

Currently, due to development of electronic communication industry, mobile communication terminals performing wireless communication, such as cellular phones, electronic notebooks, and personal digital assistants (PDA), become daily necessity of contemporary society and become quickly changed significant means for delivering information.

Recently, to overcome a shadow region difficult to receive electric waves, small base stations are constructed. Such small base stations allow traffics to be safely held and allow more and more enhanced home network services and convergence services.

Generally, a small base station uses a monopole antenna. The monopole antenna needs a ground body for grounding one end of a feeding point. FIGS. 1 and 2 are configuration views illustrating general small base stations 10 and 20.

Referring to FIG. 1, the small base station 10 includes a main board 11 for processing wireless signals via antennas, a ground plate 12 disposed above the main board 11, a plurality of antennas 131, 132, and 133 grounding the ground plate 12 at one ends thereof, and a plurality of cables 1311, 1321, and 1331 electrically connecting the antennas 131, 132, and 133 with the main board 11. The main board 11, the ground plate 12, the antennas 131, 132, and 133, and the cables 1311, 1321, and 1331 are contained in a housing 1 forming an external shape. The cables 1311, 1321, and 1331 surround a top and one side of the ground plate 12 and are extend to the main board 11. The cables 1311, 1321, and 1331 disposed as described above are a cause of deteriorating the antennas 131, 132, and 133. To prevent deterioration of the antennas, ferrite cores 1312, 1322, and 1332 are installed on the cables 1311, 1321, and 1331, respectively. However, since the ferrite cores 1312, 1322, and 1332 are installed in a limited space of the housing 1, it is difficult to arrange the plurality of antennas 131, 132, and 133 and costs of the ferrite cores 1312, 1322, and 1332 are additionally added.

Referring to FIG. 2, the small base station 20 includes a main board 21 for processing wireless signals via antennas, a ground plate 22 disposed above the main board 21, a plurality of antennas 231, 232, and 233 grounded to the ground plate 22 at one ends thereof, and a plurality of cables 2311, 2321, and 2331 electrically connecting the antennas 231, 232, and 233 with the main board 21. The main board 21, the ground plate 22, the antennas 231, 232, and 233, and the cables 2311, 2321, and 2331 are contained in a housing 2 forming an external shape. The cables 2311, 2321, and 2331 are extended from a bottom of the ground plate 22 and are partially disposed between the main board 21 and the ground plate 22. Accordingly, a space between the main board 21 and the ground plate 22 is necessary for disposing the cables 2311, 2321, and 2331. Also, a size of the small base station 20 may increase.

SUMMARY

To address the above-discussed deficiencies, it is a primary object to provide at least the advantages below. Accordingly, an object of the present disclosure is to provide antenna function of electronic devices.

Another object of the present disclosure is to provide small-sized electronic devices.

According to an aspect of the present disclosure, an electronic device includes a main board, a ground plate disposed on the main board and including at least one cable containing groove containing at least a part of at least one cable, at least one antenna disposed on the ground plate and electrically connected to the ground plate, and the at least one cable electrically connecting the at least one antenna with the main board and at least partially disposed in the at least one cable containing groove.

According to another aspect of the present disclosure, an electronic device includes an upper housing and a lower housing combined with each other and forming an external shape, a main board fastened to the lower housing and comprising a female connector, a ground plate disposed on the main board, combined with the lower housing, and comprising an antenna fastening groove, a cable containing groove, and a male connector fastening groove connected to one another, an antenna fastened to the antenna fastening groove and grounded to the ground plate, a cable disposed in the cable containing groove of the ground plate and electrically connecting the antenna with the main board, and a male connector fastened to the male connector fastening groove of the ground plate and penetrating the ground plate to be electrically connected to the female connector of the main board.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 3 through 7, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device. Preferred embodiments of the present disclosure will be described herein below with reference to the accompanying drawings. In the following description, detailed descriptions of well-known functions or constructions will be omitted since they would obscure the disclosure in unnecessary detail. Also, the terms used herein are defined according to the functions of the present disclosure. Thus, the terms may vary depending on the user's or operator's intentions or practices. Therefore, the terms used herein must be understood based on the descriptions made herein.

Figure 1:
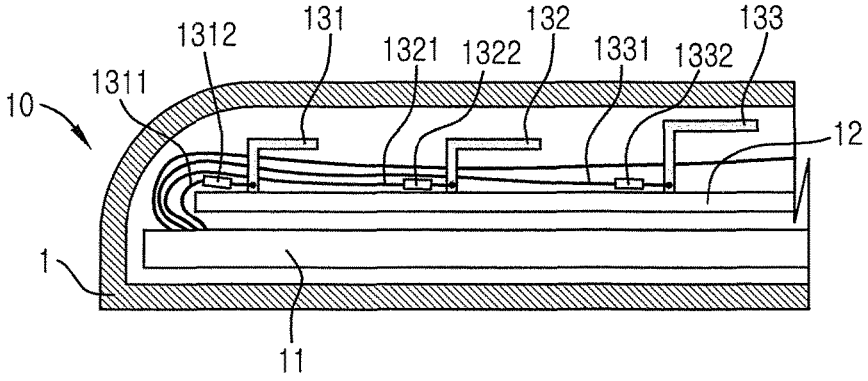
FIGS. 1 and 2 illustrate configuration views of general small base stations.
Figure 2:
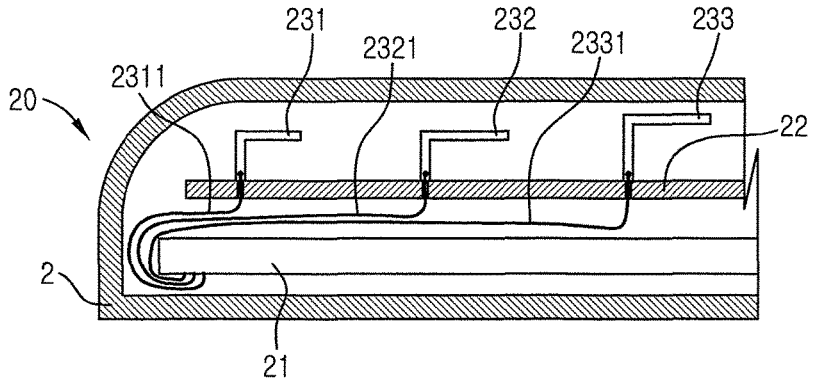
Figure 3:
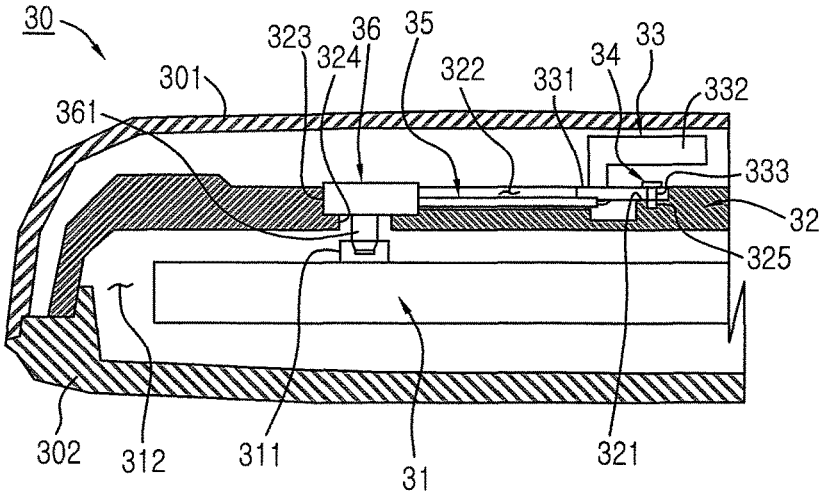
FIG. 3 illustrates a configuration view of an electronic device according to one or more embodiments of the present disclosure.

FIG. 3 illustrates a configuration view illustrating an electronic device 30 according to an embodiment of the present disclosure.

Referring to FIG. 3, the electronic device 30 may include an upper housing 301, a lower housing 302, a main board 31, a ground plate 32, an antenna 33, and a cable 35.

The upper housing 301 and the lower housing 302 may be combined with each other, may form the external shape of the electronic device 30, and may contain a plurality of electronic components. The upper housing 301 may be disposed in an upper portion of the electronic device 30, and the lower housing 302 may be disposed in a lower portion of the electronic device 30. The upper housing 301 and the lower housing 302 may be combined with each other by using bolts, adhesives, or snap-fits.

The main board 31 is a substrate on which a fundamental circuit and a plurality of electronic components are mounted. The main board 31 may set up an execution environment of the electronic device 30, may maintain information thereof, may allow the electronic device 30 to stably operate, and may allow all components of the electronic device 30 to smoothly perform data input/output exchanges. The main board 31 may include a ground (not shown). The ground may be formed in various shapes such as a flat surface, a curved surface, and a bent surface. The main board 31 may be fastened to the lower housing 302. The ground plate 32 is combined with the lower housing 302. The main board 31 may be contained in a space 312 formed by a combination between the ground plate 32 and the lower housing 302. The main board 31 may include a female connector 311 on a top thereof, the female connector 311 being connected to a male connector 36 provided on one end of the cable 35. The main board 31 may process wireless signals received via the antenna 33.

The ground plate 32 may be formed of a metallic material. The ground plate 32 may be disposed above the main board 31. The ground plate 32 may include an antenna fastening groove 32, a cable containing groove 322, and a connector fastening groove 323. The antenna fastening groove 321 may be a portion to which the antenna 33 is fastened. The cable containing groove 322 may be connected to the antenna fastening groove 321 and may be a portion in which the cable 35 is contained. The connector fastening groove 323 may be connected to the cable containing groove 322 and may be a portion to which the male connector 36 is fastened. The connector fastening groove 323 may include an opening 324 penetrating top and bottom thereof. A connecting portion 361 of the male connector 36 may penetrate the opening 324 and may protrude downwardly below the ground plate 32. The ground plate 32 may be electrically connected to the ground of the main board 31. The ground plate 32 may be electrically connected to a metal portion (not shown) disposed on the upper housing 301 or the lower housing 302, such as a metal plate and a metallic application material.

The antenna 33 may include a fastening portion 331 and an emission portion 332. The fastening portion 331 may be inserted into the antenna fastening groove 321. The emission portion 332 may be extended from the fastening portion 331 and may be separated from the ground plate 32. The emission portion 332 may have diverged branches. The fastening portion 331 may include a screw combining hole 333 and may be inserted into the antenna fastening groove 321 of the ground plate 32. A screw 34 penetrates the screw combining hole 333 and is combined with a screw combining groove 325 of the ground plate 32, thereby allowing the antenna 33 to be fastened to the ground plate 32 and to be electrically connected to the ground plate 32. The emission portion 332 may receive currents from the main board 31 through the cable 35 and may be resonant at least one resonance frequency. The antenna 33 having a configuration as described above may be designated as a monopole antenna device or a ground antenna device.

The cable 35 may be contained in the cable containing groove 322 of the ground plate 32. One end of the cable 35 may be extended below the fastening portion 331 of the antenna 33 and may be electrically connected to the emission portion 332 of the antenna 33. The cable 35 may be electrically connected to the emission portion 332 of the antenna 33 and the male connector 36 by soldering or screwing. The cable 35 may be formed by covering a metallic line (not shown) with a coating material (not shown). The cable 35 may be flexible.

The ground plate 32 to which the antenna 33, the cable 35, and the male connector 36 are fastened may be combined with the lower housing 302. The male connector 36 of the ground plate 32 may be electrically connected to the female connector 311 of the main board 31. Accordingly, the main board 31 may supply currents to the antenna 33 through the female connector 311, the male connector 36, and the cable 35 and may process wireless signals received through the antenna 33.

The electronic device 30 may be used to perform wireless communications of a small base station, a mobile communication terminal, a cellular phone, an electronic notebook, a personal digital assistant (PDA), etc.

Also, various other examples may be available in addition to a connection type of electrically bonding the male connector 36 of the ground plate 32 with the female connector 311 of the main board 31. For example, an electric contact type may be applied. An elastic contact element such as an elastic metal plate and a metal spring may be connected to one end of the cable 35 and may be fastened to the top of the ground plate 32. The ground plate 32 may have a groove for fastening the elastic contact element, and the groove may have an opening through which a pressing portion of the elastic contact element penetrates. Also, the main board 31 may have a contact portion in contact with the pressing portion of the elastic contact element. Accordingly, the pressing portion of the elastic contact element may penetrate the opening 324, may protrude downwardly below the ground plate 32, and may be in electrical contact with the contact portion of the main board 31. Also, the elastic contact element may be attached to a bottom surface of the ground plate 32. The cable 35 may be extended below the ground plate 32 through an opening formed in the ground plate 32 and may be electrically connected to the elastic contact element.

Figure 4:
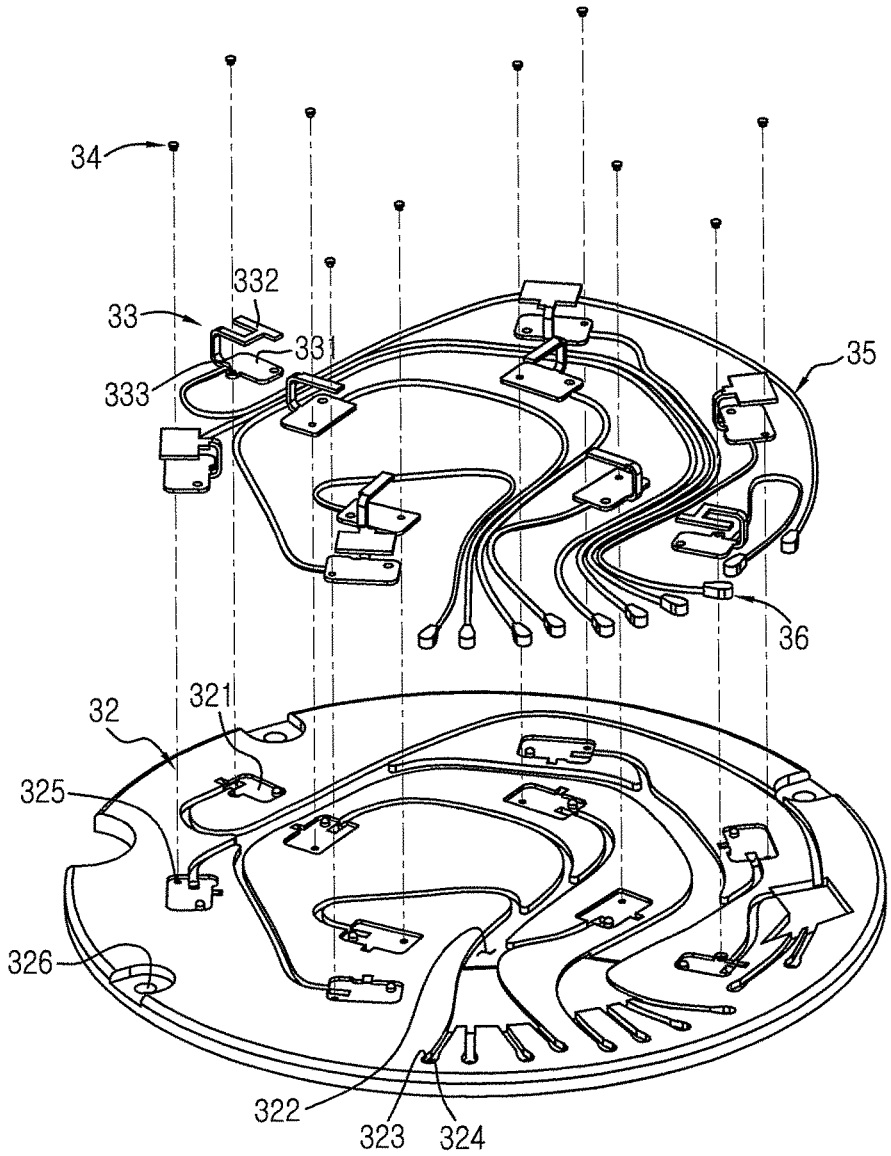
FIG. 4 illustrates an exploded perspective view of the ground plate, antennas, and cables of FIG. 3.
Figure 5:
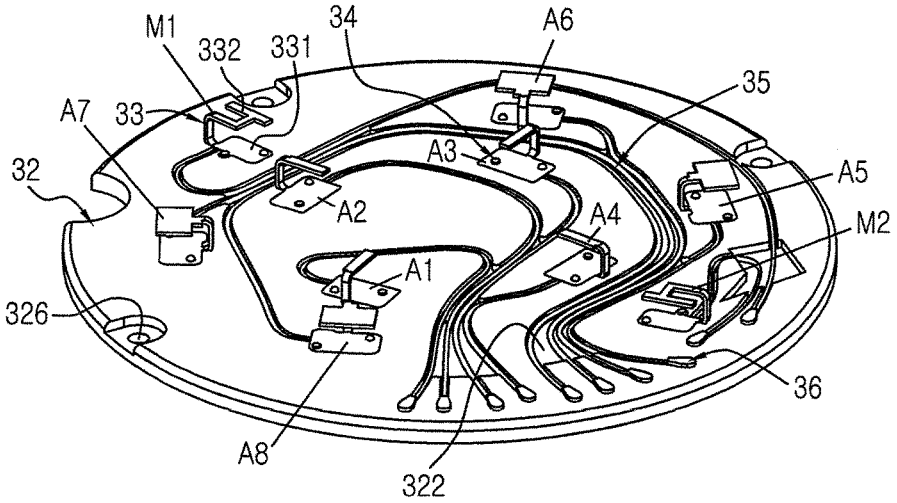
FIG. 5 illustrates a combined perspective view illustrating the ground plate, the antennas, and the cables of FIG. 3.

FIG. 4 illustrates an exploded perspective view of the ground plate 32, the antenna 33, and the cable 35, and FIG. 5 is a combined perspective view illustrating the ground plate 32, the antenna 33, and the cable 35.

Referring to FIGS. 4 and 5, the ground plate 32 may include the antenna fastening groove 321 to which the antenna 33 is fastened, the cable containing groove 322 connected to the antenna fastening groove 321 and containing the cable 35, and the connector fastening groove 323 connected to the cable containing groove 322 and fastening the male connector 36. The connector fastening groove 323 may include the opening 324. The connecting portion 361 of the male connector 36 may penetrate the opening 324 and may protrude downwardly below the ground plate 32. A shape of the cable containing groove 322 is various, which will be described with reference to FIGS. 6A to 6F. A plurality of cables joining together is arranged in parallel horizontally. The cable containing groove 322 of the ground plate 32 may have a width corresponding thereto. Also, the ground plate 32 may have a hole 326 for being screwed together with the lower housing 302.

The antenna 33 may include the fastening portion 331 inserted into the antenna fastening groove 321 and the emission portion 332 extended from the fastening portion 331 and separated from the ground plate 32. The fastening portion 331 of the antenna 33 may include the screw combining groove 333 and may be inserted into the antenna fastening groove 321. The screw 34 penetrates the screw combining hole 333 and is combined with a screw combining groove 325 of the ground plate 32, thereby allowing the antenna 33 to be fastened to the ground plate 32 and to be electrically connected to the ground plate 32. The electronic device 30 may be a small base station and may include ten antennas, in which eight antennas A1 to A8 may be used for communication and other two antennas M1 and M2 may be used for monitoring. Many of the antennas A1 to A8 for communication and the antennas M1 and M2 for monitoring may have the same shape.

The cable 35 may be contained in the cable containing groove 322 of the ground plate 32. One end of the cable 35 may be extended below the fastening portion 331 of the antenna 33 and may be electrically connected to the emission portion 332 of the antenna 33. Also, another end of the cable 35 may be electrically connected to the male connector 36. Since the cable 35 is inserted into and fastened to the cable containing groove 322 of the ground plate 32 and can not move, changes in properties of the antenna caused by the cable 35 may be reduced.

FIGS. 6A to 6F illustrate various examples of the cable containing groove 322 of the ground plate 32.

Figure 6A:
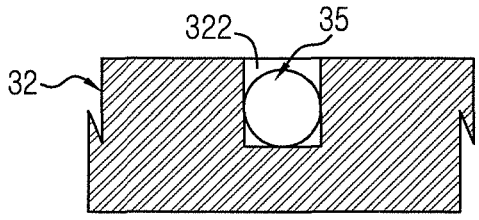
FIGS. 6A to 6F illustrate various examples of a cable containing groove of the ground plate.

Referring to FIG. 6A, the cable containing groove 322 may be formed on the top of the ground plate 32 and may have a rectangular cross section. The cable containing groove 322 has a depth greater than a thickness of the cable 35 to allow the cable 35 not to protrude from the ground plate 32.

Figure 6B:
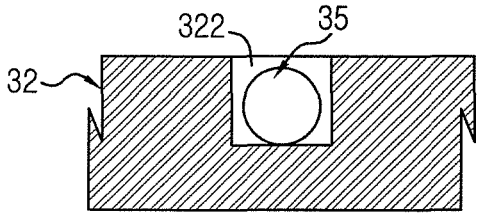

Referring to FIG. 6B, the cable containing groove 322 may be formed on the top of the ground plate 32 and may have a rectangular cross section. The cable containing groove 322 may have width and depth each greater than the thickness of the cable 35.

Figure 6C:
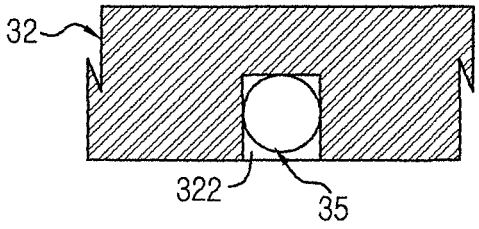

Referring to FIG. 6C, the cable containing groove 322 may be formed on the bottom of the ground plate 32 and may have a rectangular cross section. The cable containing groove 322 has a depth greater than the thickness of the cable 35 to allow the cable 35 not to protrude from the ground plate 32.

Figure 6D:
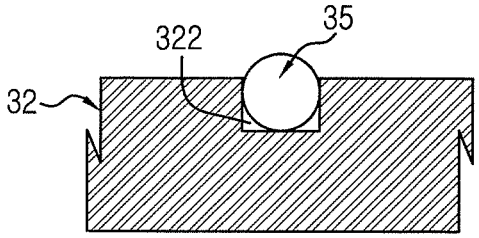

Referring to FIG. 6D, the cable containing groove 322 may be formed on the top of the ground plate 32 and may have a rectangular cross section. The cable containing groove 322 has a depth smaller than the thickness of the cable 35 to allow the cable 35 not to partially protrude from the ground plate 32.

Figure 6E:
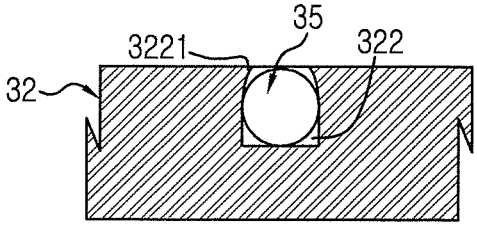

Referring to FIG. 6E, the cable containing groove 322 may be formed on the top of the ground plate 32. A shape of the cross section of the cable containing groove 322 may be generally rectangular. An inlet 3221 of the cable containing groove 322 may have a bottleneck shape having a width smaller than the thickness of the cable 35. Since a covering of the cable 35 is formed of an elastic material such as urethane, although the inlet 3221 of the cable containing groove 322 is narrower than the thickness of the cable 35, the cable 35 may be inserted into the cable containing groove 322. The cable 35 inserted into the cable containing groove 322 as described above may not be separated from the cable containing groove 322 without being fastened by using an additional attachment element such as an adhesive tape.

Figure 6F:
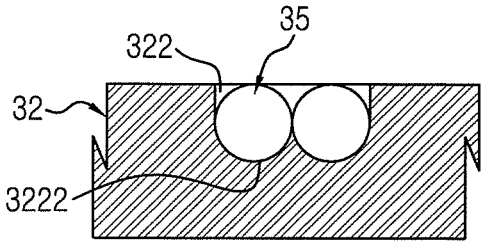

Referring to FIG. 6F, the cable containing groove 322 may be formed on the top of the ground plate 32 and may have a bottom 3222 having a shape corresponding to a circular outline of the cable 35. Accordingly, when a plurality of cables is arranged in parallel horizontally, it may be easy to separate cables from one another and arrange the cables.

Figure 7:
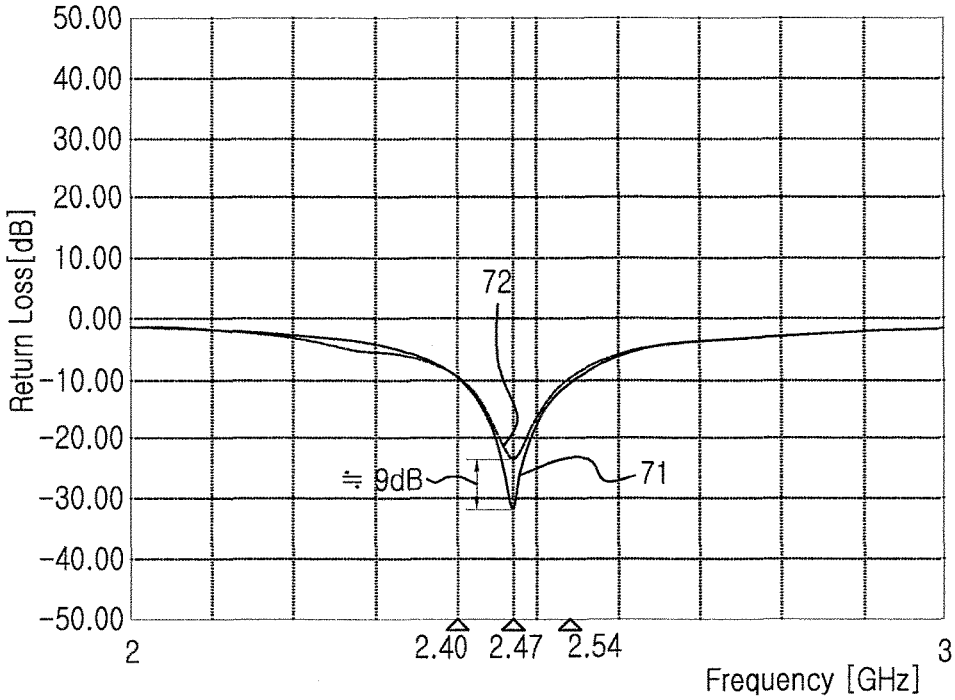
FIG. 7 illustrates a graph illustrating performance comparison between a monopole antenna device in which cables are contained in a ground plate according to an embodiment of the present disclosure and a general monopole antenna device in which cables are not contained in a ground plate.

FIG. 7 illustrates a graph of a performance comparison between a monopole antenna device in which cables are contained in a ground plate according to an embodiment of the present disclosure and a general monopole antenna device in which cables are not contained in a ground plate.

Referring to FIG. 7, a full line 71 is a graph illustrating a return loss of a monopole antenna device containing a cable in a ground plate and a broken line 72 is a graph illustrating a return loss of a monopole antenna device not containing a cable in a ground plate. Considering a return loss in an industrial scientific medical (ISM) band of 2.4 GHz to 2.54 GHz, the monopole antenna device containing the cable in the ground plate has a more excellent return loss of about 9 dB at a resonant frequency of 2.47 GHz than the monopole antenna device not containing the cable in the ground plate.

The present embodiment is not limited to the monopole antenna device. When it is necessary to arrange cables on the periphery of antennas in a planar inverted-F antenna (PIFA) device or a dipole antenna device, grooves may be formed not only in a ground plate but also a peripheral structure such as a case frame or housing and the cables may be arranged in the grooves. Since the cables are contained in the grooves and do not move, changes in properties of the antennas are reduced.

Also, the antenna device according to the present embodiment may be a multiple-input multiple-output (MIMO) antenna device.

According to various embodiments of the present disclosure, the electronic device 30 may include the main board 31, the ground plate 32 disposed above the main board 31 and including at least one cable containing groove 322 containing at least a part of at least one cable 35, at least one antenna 33 disposed above the ground plate 32 and electrically connected to the ground plate 32, and the at least one cable 35 electrically connecting the at least one antenna 33 with the main board 31 and at least partially disposed in the at least one cable containing groove 322.

The at least one cable containing groove 322 may be formed on one of the top and bottom of the ground plate 32.

The at least one cable containing groove 322 may have a depth different from a thickness of the at least one cable 35 or may have the same depth as the thickness of the at least one cable 35.

The at least one cable containing groove 322 may have a rectangular cross section.

The at least one cable containing groove 322 may have a bottom corresponding to a circular outline of the at least one cable 35.

The at least one cable 35 may not protrude from the ground plate 32.

The at least one cable 35 may be disposed in parallel with another adjacent cable horizontally.

The ground plate 32 may include at least one antenna fastening groove 321 fastening the at least one antenna 33.

The at least antenna fastening groove 321 and the at least one cable containing groove 322 may be connected to one another.

The at least one cable 35 may include at least one connector 36 electrically connected to the main board 31.

The ground plate 32 may include at least one connector fastening groove 323 fastening the at least one connector 36 and forming the opening 324 penetrating a part of the at least one connector 36 toward the main board 31.

The at least connector fastening groove 323 and the at least one cable containing groove 322 may be connected to one another.

The at least one main board 31 may include at least one connector 311 electrically connected to the connector 36 of the at least one cable 35.

The at least one antenna 33 may include the fastening portion 331 electrically combined with the ground plate 32 and the emission portion 332 extended from the fastening portion 331 and separated from the ground plate 32.

The fastening portion 331 of the at least one antenna 33 may be electrically connected to the ground plate 32 by using the screw 34.

The at least one antenna 33 may be at least one of the antennas A1 to A8 for communications and the antennas M1 and M2 for monitoring.

The at least one antenna 33 may transmit or receive signals in the ISM band of 2.4 GHz to 2.54 GHz.

The electronic device 30 may further include a housing. The housing may include the upper housing 301 and the lower housing 302 combined with the upper housing 301.

The ground plate 32 is combined with the lower housing 302. The main board 31 may be contained in a space formed by a combination between the ground plate 32 and the lower housing 302.

The main board 31 may be fastened to the lower housing 302.

The electronic devices according to various embodiments of the present disclosure may provide antenna function by disposing cables in grooves provided in ground plates and may reduce sizes thereof.

While the disclosure has been shown and described with reference to certain preferred embodiments thereof, it will be understood by those skilled in the art that various changes in form and details may be made therein without departing from the spirit and scope of the disclosure as defined by the appended claims. Therefore, the scope of the disclosure is defined not by the detailed description of the disclosure but by the appended claims, and all differences within the scope will be construed as being included in the present disclosure.

What is claimed is:

1. An electronic device comprising:

a main board;

a ground plate disposed on the main board and comprising at least one first groove at least one second groove, and at least one third groove, wherein each of the at least one first groove is connected to each of the at least one second groove;

at least one antenna disposed on the at least one first groove and electrically connected to the ground plate; and at least one cable electrically connecting the at least one antenna with the main board through at least one connector and disposed in the at least one second groove, wherein each of the at least one cable connects each of the at least one antenna with each of the at least one connector disposed in the at least one third groove of the ground plate.

2. The device of claim 1, wherein the at least one second groove is formed on at least one of a top or a bottom of the ground plate.

3. The device of claim 1, wherein the at least one second groove has a depth different from a thickness of the at least one cable or has the same depth as the thickness of the at least one cable.

4. The device of claim 1, wherein the at least one second groove has a rectangular cross section.

5. The device of claim 1, wherein the at least one second groove comprises a bottom corresponding to a circular outline of the at least one cable.

6. The device of claim 1, wherein the at least one cable does not protrude from the ground plate.

7. The device of claim 1, wherein the at least one cable is disposed in parallel with another adjacent cable horizontally.

8. The device of claim 1, wherein the at least one first groove fastens the at least one antenna.

9. The device of claim 1, wherein the at least one connector is electrically connected to the main board.

10. The device of claim 9, wherein the at least one third groove forms an opening penetrating a part of the at least one connector toward the main board.

11. The device of claim 10, wherein the at least one third groove is connected to the at least one second groove.

12. The device of claim 10, wherein the main board comprises at least one other connector electrically connected to the at least one connector.

13. The device of claim 1, wherein the at least one antenna comprises:

a fastening portion electrically combined with the ground plate; and an emission portion extended from the fastening portion and separated from the ground plate.

14. The device of claim 13, wherein the fastening portion of the at least one antenna is electrically connected to the ground plate by using a screw.

15. The device of claim 1, wherein the at least one antenna is at least one of an antenna for communication or an antenna for monitoring.

16. The device of claim 1, wherein the at least one antenna transmits or receives signals in an industrial scientific medical (ISM) band of 2.4 GHz to 2.54 GHz.

17. The device of claim 1, further comprising a housing forming an external shape, the housing comprises:

an upper housing; and a lower housing combined with the upper housing.

18. The device of claim 17, wherein the ground plate is combined with the upper housing, wherein the main board is contained in a space formed by a combination between the ground plate and the upper housing.

19. The device of claim 17, wherein the main board is fastened to the lower housing.

20. An electronic device comprising:

an upper housing and a lower housing combined with each other and forming an external shape;

a main board fastened to the lower housing and comprising a female connector;

a ground plate disposed on the main board, combined with the lower housing, and comprising at least one first groove, at least one second groove, and at least one third groove, wherein each of the at least one first groove is connected to each of the at least one second groove;

at least one antenna disposed on the at least one first groove and electrically connected to the ground plate;

at least one cable disposed in the at least one second groove and electrically connecting the antenna with the main board; and at least one male connector disposed in the at least one third groove of the ground plate and penetrating the ground plate to be electrically connected to the female connector of the main board, wherein each of the at least one cable connects each of the at least one antenna with each of the at least one male connector disposed in the at least one third groove of the ground plate.

* * * * *